US005286221A

United States Patent [19]

Fencl et al.

[11] Patent Number: 5,286,221

[45] Date of Patent: Feb. 15, 1994

[54] FILTERED ELECTRICAL CONNECTOR ASSEMBLY

[75] Inventors: Duane M. Fencl, Countryside; Stephen A. Colleran, Lisle; Burke J. Crane, Lombard; Robert M. Fuerst, Maple Park; Fred L. Krehbiel, Chicago; Jeffrey J. Pawlicki, Downers Grove; Edward J. Plocek, Lisle; Thomas G. Premo, West Chicago; Bill B. Wilson, Montgomery, all of Ill.

[73] Assignee: Molex Incorporated, Lisle, Ill.

[21] Appl. No.: 962,763

[22] Filed: Oct. 19, 1992

[51] Int. Cl.[5] ..... H01R 13/648

[52] U.S. Cl. ..... 439/607; 439/620; 29/884

[58] Field of Search ..... 439/607, 610, 620; 29/884

[56] References Cited

U.S. PATENT DOCUMENTS

| | | | |
|---|---|---|---|
| 4,761,147 | 8/1988 | Gauthier | 439/607 |
| 4,854,890 | 8/1989 | Nishimura | 439/607 |
| 5,080,596 | 1/1992 | Viselli et al. | 439/79 |
| 5,112,233 | 5/1992 | Lybrand | 439/79 |
| 5,180,312 | 1/1993 | Martin | 439/78 |
| 5,213,522 | 5/1993 | Kojima | 439/620 |
| 5,224,878 | 7/1993 | Lurie et al. | 439/620 |

FOREIGN PATENT DOCUMENTS

| | | | |
|---|---|---|---|
| 0467400A1 | 7/1990 | European Pat. Off. | H01R 13/658 |
| WO9106136 | 10/1989 | PCT Int'l Appl. | H01R 13/719 |

*Primary Examiner*—P. W. Echols

*Attorney, Agent, or Firm*—A. A. Tirva

[57] ABSTRACT

A multi-terminal filtered electrical connector assembly includes a housing having a plurality of terminal-receiving passageways. A plurality of terminals are received in the passageways, with tail portions of the terminals projecting from the housing. A terminal alignment plate, independent of the housing, includes a plurality of through holes for receiving and aligning the tail portions of the terminals. First complementary interengaging latch devices are provided between the housing and the alignment plate for readily assembling the alignment plate on the housing. A ferrite block is mountable on the alignment plate and includes a plurality of through holes alignable with the holes in the alignment plate for receiving therethrough the tail portions of the terminals. Second complementary interengaging latch devices are provided between the alignment plate and the ferrite block for readily assembling the ferrite block on the alignment plate. Therefore, the alignment plate and the ferrite block can be assembled as a subassembly about the tail portions of the terminals, and the subassembly can be readily assembled to the housing. A flexible capacitor filter circuit is mounted on a rear face of the housing and through which filters the terminals extend.

12 Claims, 3 Drawing Sheets

FILTERED ELECTRICAL CONNECTOR ASSEMBLY

FIELD OF THE INVENTION

This invention generally relates to the art of electrical connectors and, particularly, to a multi-terminal electrical connector assembly which includes terminal alignment means and filtering means such as a ferrite block.

BACKGROUND OF THE INVENTION

Electrical circuitry often is used in environments wherein the circuitry must be protected from disruptions or "noise" caused by electromagnetic interference (EMI), radio frequency interference (RFI), electrostatic discharges (ESD) and/or electromagnetic pulses (EMP). Such applications may range from use in high frequency pulse circuits, such as computers, wherein signals are generated which will cause radio frequency interference and electromagnetic interference to nearby radio and other electronic devices, to automotive applications wherein equipment must be protected against power surges owing to electrostatic discharges and electromagnetic pulses as well. A high voltage generated by electrostatic discharges and electromagnetic pulses can damage voltage sensitive integrated circuits and the like.

One environment wherein such problems have become prevalent is in the automotive industry wherein electronics, including computer circuitry, have become common to control, monitor or otherwise interconnect all kinds of electrical circuitry within the operative systems of the vehicle. This invention is directed to such applications and, particularly, to a main electrical connector assembly which is utilized "under the hood" of an automobile or other vehicle which employs a multitude of electrical interconnections. In fact, the connector disclosed herein may employ as many as eighty terminals.

In environments as described above, it is desirable to provide the connector assembly with a filtering capability, such as to suppress EMI and RFI, and transient suppression means to suppress EMP and ESD interference or other undesirable signals which may exist in circuits terminated to the connectors. Employing filter components in a connector assembly creates problems in manufacture and assembly because of the undue complexity of the connectors, particularly in substantially increasing the assembly costs of the connectors. In the extremely high volume environment of automotive applications, cost considerations can be extremely important. In high density connectors, such as the main connector assembly of an automobile, still additional considerations must be addressed in aligning the terminals at a proper spacing or "pitch" and to protect pin or tail portions of the connector terminals during manufacture, assembly and/or use. This is particularly true when the connector assembly is mounted to a printed circuit board. Alignment components add still further complexity and cost to the connectors.

This invention is directed to solving the myriad of problems identified above and to provide a multi-terminal connector assembly with filtering means and terminal alignment means which are extremely simple and easy to manufacture and assemble.

SUMMARY OF THE INVENTION

An object, therefore, of the invention is to provide a new and improved multi-terminal filtered electrical connector assembly of the character described.

In the exemplary embodiment of the invention, the connector assembly includes a housing having a plurality of terminal-receiving passageways. A plurality of terminals are received in the passageways, with tail portions of the terminals projecting from the housing. The tail portions may be provided, for instance, for insertion into holes in a printed circuit board. A terminal alignment plate, independent of the housing, is provided with a plurality of through holes for receiving and aligning the tail portions of the terminals. First complementary interengaging latch means are provided between the housing and the alignment plate for readily assembling the alignment plate on the housing. A ferrite filtering block is mountable on the alignment plate and has a plurality of through holes alignable with the holes in the alignment plate for receiving therethrough the tail portions of the terminals. Second complementary interengaging latch means are provided between the alignment plate and the ferrite block for readily assembling the ferrite block on the alignment plate. Therefore, the alignment plate and the ferrite block can be conveniently and efficiently assembled as a subassembly about the tail portions of the terminals. The subassembly is readily assembled to the housing of the connector assembly.

As disclosed herein, the housing is constructed to provide a right angle connector mountable to a printed circuit board, with the terminals extending through the passageways generally parallel to the circuit board. The tail portions of the terminals are oriented at right angles to the circuit board. The first complementary interengaging latch means are constructed to mount the terminal alignment plate on the housing with the through holes in the alignment plate generally perpendicular to the passageways in the housing.

The invention contemplates that the first and second complementary interengaging latch means be automatically interengageable, such as by means of snap-latch devices which latch the ferrite block to the alignment plate automatically in response to assembling the ferrite block on the alignment plate, and to latch the alignment plate to the housing automatically in response to assembling the alignment plate on the housing.

Lastly, the invention contemplates a flexible capacitor filter circuit mounted on the housing and through which the terminals extend. As disclosed herein, the housing has a rear face with the terminal-receiving passageways communicating therethrough. The flexible capacitor filter circuit is generally flat and is mounted against the rear face of the housing. The flexible capacitor filter circuit includes a plurality of chip capacitors operatively associated with the tail portions of the terminals passing through the filter circuit.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
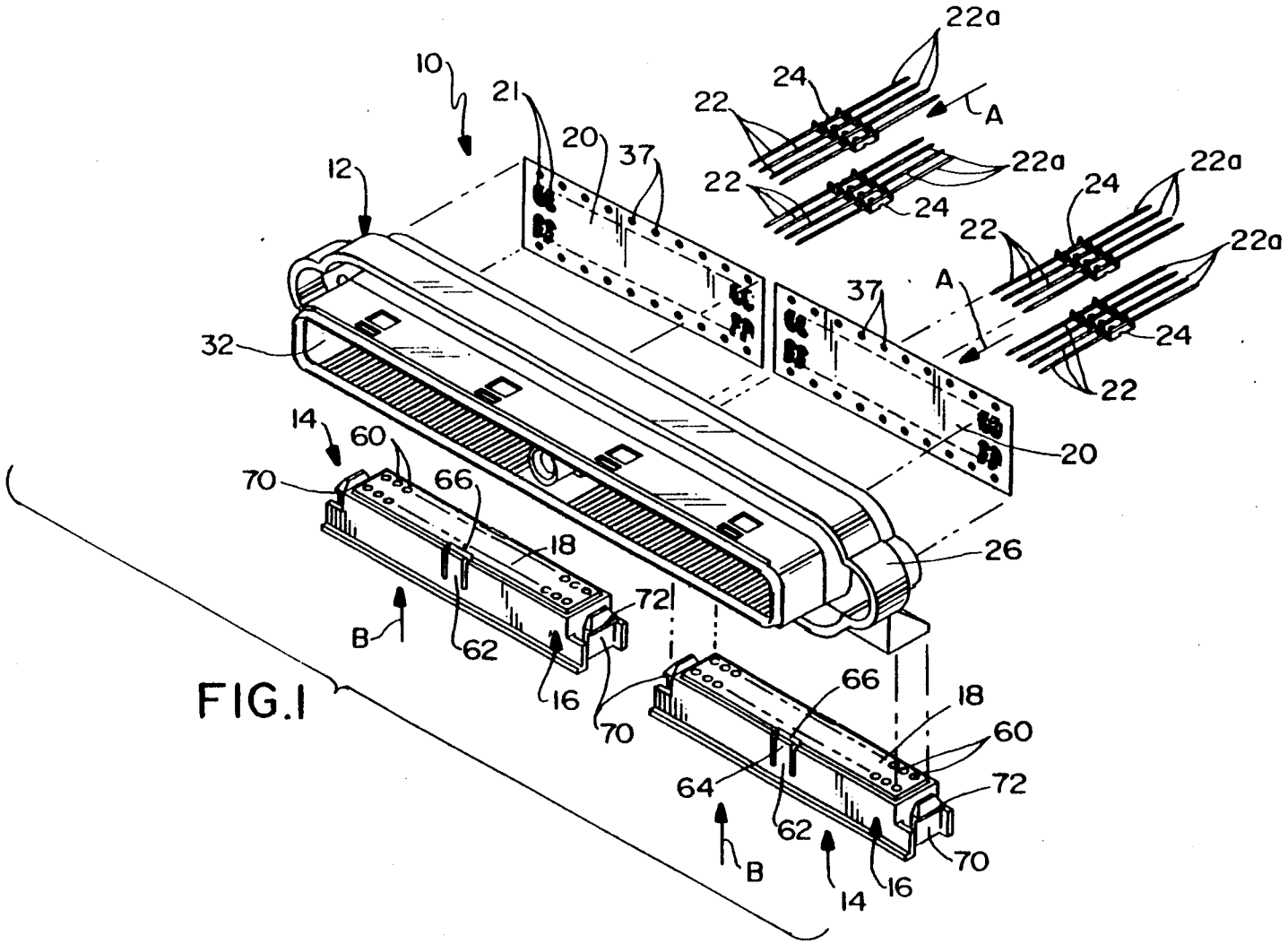
FIG. 1 is an exploded perspective view of the multi-terminal filtered electrical connector assembly of the invention.

Referring to the drawings in greater detail, and first to FIG. 1, the invention is incorporated in a multi-terminal filtered electrical connector assembly, generally designated 10. The connector assembly includes a main connector housing assembly, generally designated 12, and a pair of subassemblies, generally designated 14. Each subassembly 14 includes a terminal alignment plate, generally designated 16, which receives and mounts a ferrite filter block 18. The subassemblies are mounted to main connector 12, as will be described in greater detail hereinafter. A pair of flexible capacitor filter circuits 20 are mounted to the rear of connector 12, again as described in greater detail hereinafter. A plurality of terminals 22 are mounted in main connector 12 and are assembled, through flexible capacitor filter circuits 20, to the main connector in the direction of arrows "A". Each flexible capacitor filter circuit has a plurality of chip capacitors 21 operatively associated with the terminals passing therethrough. Each terminal 22 includes a tail portion 22*a*. For illustration purposes, FIG. 1 shows groups of terminals 22 retained on bandolier holders 24 which simply are used temporarily for inserting the terminals into main connector 12 in the direction of arrows "A". Although only sixteen terminals are shown in groups of four, connector 12 can mount as many as eighty or more terminals.

Figure 2:
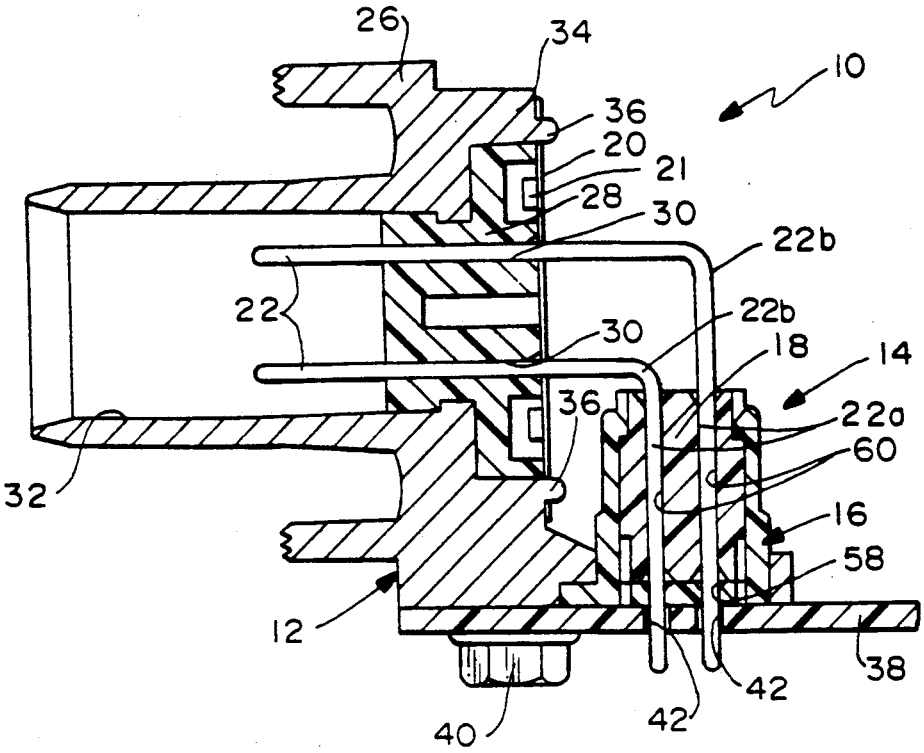
FIG. 2 is a side view cross section, on an enlarged scale, through the connector assembly and with the assembly mounted to a printed circuit board.

Referring to FIG. 2 in conjunction with FIG. 1, main connector 12 includes a die cast housing 26 having an injection molded dielectric insert 28. The housing, through insert 28, includes a plurality of through passageways 30 for receiving terminals 22 whereby forward mating ends of the terminals are exposed in a cavity 32 of the housing. The cavity is provided for receiving a complementary electrical connector assembly (not shown) which will have female terminals for interengagement with terminals 22. Die cast housing 26 defines a rear face 34 thereof, with a plurality of mounting pegs 36 projecting from the rear face for insertion into mounting holes 37 in flexible capacitor filter circuits 20 to mount the circuits to the rear of the housing.

Still referring to FIG. 2 in conjunction with FIG. 1, it can be seen that main connector 12, particularly die cast housing 26, is constructed to provide a right angle connector mountable to a printed circuit board 38, with terminals 22 extending through passageways 30 generally parallel to the printed circuit board. Appropriate fastening means 40 is provided for securing main connector 12, through its housing, to the printed circuit board in its right angle orientation. It can be seen that terminals 22 are bent at right angles, as at 22*b*, so that tail portions 22*a* of the terminals extend perpendicular to printed circuit board 38 for insertion into appropriate holes 42 in the circuit board for interconnection to appropriate circuit traces on the board or in the holes.

Figure 3:
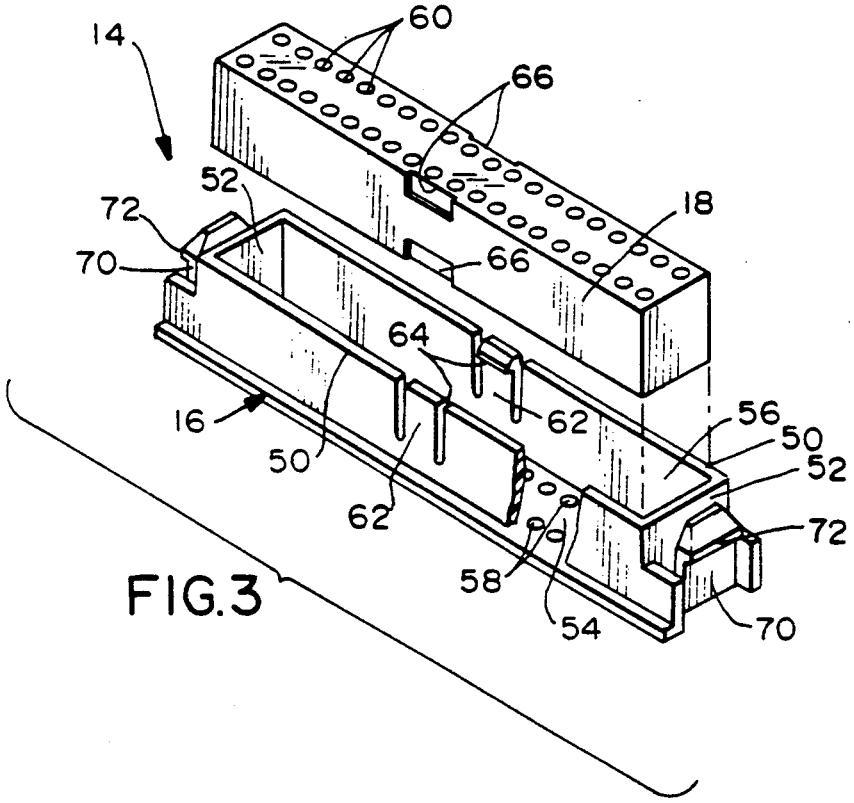
FIG. 3 is an exploded perspective view of one of the terminal alignment plate/ferrite block subassemblies of the connector assembly.

Referring to FIG. 3 in conjunction with FIGS. 1 and 2, each subassembly 14 includes terminal alignment plate 16 and ferrite block 18, as stated above. More particularly, terminal alignment plate 16 is generally box-shaped to define a pair of side walls 50, a pair of end walls 52 and a bottom wall or plate 54 which combine to define an elongated, generally rectangular cavity 56 for receiving ferrite filtering block 18. Bottom wall or plate 54 of terminal alignment plate 16 includes a plurality of properly positioned and spaced through holes 58 for receiving tail portions 22*a* of terminals 22. In other words, through holes 58 in the terminal alignment plate are in a pattern or array to match holes 42 in printed circuit board 38.

Ferrite block 18 is elongated and generally rectangular in cross section and is sized and configured for fitting into cavity 56 of terminal alignment plate 16. The ferrite block includes a plurality of through holes 60 which are in alignment with through holes 58 in the terminal alignment plate when the ferrite block is fitted into the cavity of the alignment plate. Therefore, tail portions 22*a* of terminals 22 extend completely through both the ferrite block and the terminal alignment plate. Two subassemblies 14, including one terminal alignment plate 16 and one ferrite block 18, are provided for manufacturing and assembly convenience.

Generally, complementary interengaging latch means are provided between terminal alignment plate 16 and ferrite block 18 for readily assembling the ferrite block in the alignment plate. Specifically, alignment plate 16 may be unitarily molded of dielectric material, such as plastic or the like, and a pair of flexible latch arms 62 are formed out of side walls 50 of the alignment plate. The latch arms have inwardly directed hook portions 64. The sides of ferrite block 18 are provided with latch recesses 66. It can be seen in FIG. 3 that latch recesses 66 are provided on both the top edges and bottom edges of the block. Therefore, the ferrite block can be fitted into cavity 56 of the alignment plate regardless of the vertical or horizontal orientation of the block. In essence, latch arms 62, with their inwardly directed hook portions 64, and latch recesses 66 provide snap-latch devices for latching the ferrite block to the alignment plate automatically in response to assembling the ferrite block into the cavity of the alignment plate.

Figure 4:
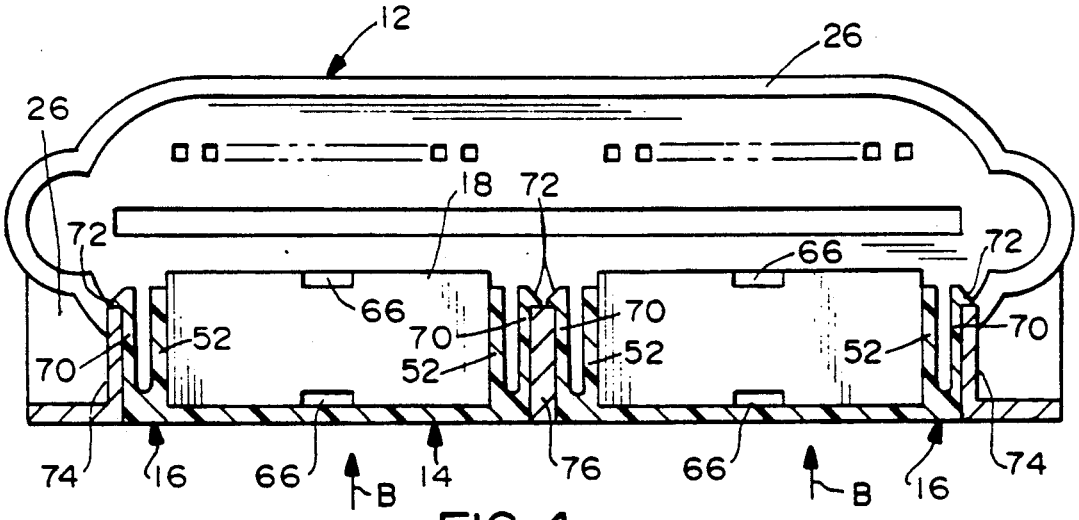
FIG. 4 is a fragmented vertical section through the rear of the connector assembly housing illustrating the latch means for the terminal alignment plate/ferrite block subassemblies.

Generally, complementary interengaging latch means are provided between die cast housing 26 and each terminal alignment plate 16 for readily assembling the alignment plate on the housing. Specifically, and referring to FIGS. 3 and 4 in conjunction with FIG. 1, each terminal alignment plate 16 has a flexible latch arm 70 at each opposite end thereof, spaced outwardly from the adjacent end wall 52, and including an outwardly directed hook portion 72. As seen in FIG. 4, die cast housing 26 of main connector 12 includes a pair of end wall sections 74 and a center partition section 76 which define shoulders at the tops thereof. The end wall sections 74 and the partition section 76 are positioned for receiving subassemblies 14, including terminal alignment plates 16, therebetween. When the subassemblies are assembled to main connector 12 in the direction of arrows "B" (FIG. 4), hook portions 72 of flexible latch arms 70 snap behind the top edges of end wall sections 74 and partition section 76 of the die cast housing 26. In essence, the latch arms 70 and hook portions 72 provide snap-latch devices for latching the alignment plates (therefore subassemblies 14) to die cast housing 26 automatically in response to assembling the subassemblies to the housing in the direction of arrows "B". When the entire electrical connector assembly 10 is mounted to printed circuit board 38 as shown in FIG. 2, the subassemblies are locked into position in conjunction with main connector 12 and the printed circuit board.

In overall assembly, main connector housing assembly 12 first is prepared by injection molding insert 28 (FIG. 2) into die cast housing 26. Flexible capacitor filter circuits 20 then are mounted onto rear face 34 of the die cast housing by means of mounting pegs 36 (FIG. 2) and mounting holes 37 (FIG. 1). Terminals 22 then are inserted through filter circuits 20 into passageways 30 of insert 28 by appropriate means such as bandolier holders 34. Either before or after the terminals are mounted into the main connector housing assembly 12, the terminals are bent at right angles, as at **22*b* in FIG. 2. Either before or after these procedures, subassemblies 14 are assembled by snap-latching ferrite blocks 18 into terminal alignment plates 16 as described above. The subassemblies then are snap-latched onto die cast housing 26 simultaneously with inserting tail portions 22*a* of the terminals through holes 60 in the ferrite block and holes 58 in the alignment plate. The entire multi-terminal filtered electrical connector assembly 10 now is ready to be assembled to printed circuit board 38, with the tail portions of the terminals properly aligned for insertion into the array of holes 42 in the printed circuit board. The assembly operation is extremely simple, the tail portions may be connected mechanically and electrically to conductive traces on the circuit board by any of the well known methods such as soldering, conductive epoxy or the like. When fully assembled, ferrite block 18 and flexible capacitor filter circuits 20** form an inductive capacitance filter circuit within the connector assembly.

Figure 5:
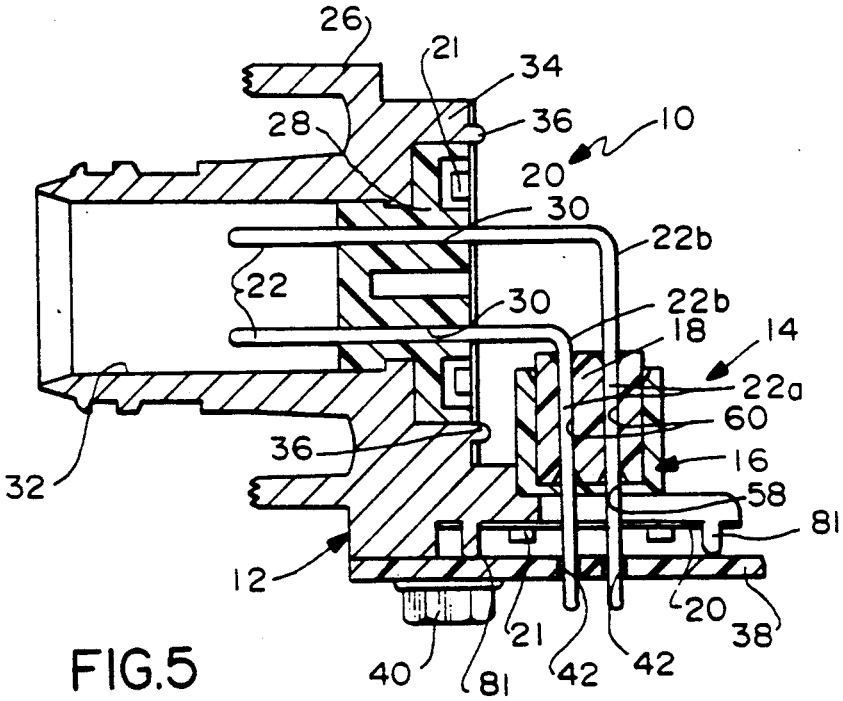
FIG. 5 is a view similar to the view shown in FIG. 2, illustrating an alternate embodiment of the invention.

When the connector assembly requires additional filtering, flexible capacitor filter circuits 20 may be also mounted to the bottom of the pin alignment plate 16, as shown in FIG. 5 by means of mounting pegs 81 which are also used as stand-offs to keep the flexible capacitors 20 out of contact with the printed circuit board 38. The arrangement allows the tail portions of terminals 22 to pass through the flexible circuit 20 before entering holes 42 in the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A multi-terminal filtered electrical connector assembly, comprising:

a housing having a plurality of terminal-receiving passageways;

a plurality of terminals received in the passageways with tail portions of the terminals projecting from the housing;

a terminal alignment plate independent of the housing and having a plurality of through holes for receiving and aligning the tail portions of the terminals;

first complementary interengaging latch means between the housing and the alignment plate for readily assembling the alignment plate on the housing;

a ferrite block mountable on the alignment plate and having a plurality of through holes alignable with the holes in the alignment plate for receiving therethrough the tail portions of the terminals; and second complementary interengaging latch means between the alignment plate and the ferrite block for readily assembling the ferrite block on the alignment plate, whereby the alignment plate and the ferrite block can be assembled as a subassembly about the tail portions of the terminals and the subassembly can be readily assembled to the housing.

2. The multi-terminal filtered electrical connector assembly of claim 1 wherein said housing is constructed to provide a right angle connector mountable to a printed circuit board, with said terminals extending through said passageways generally parallel to the circuit board.

3. The multi-terminal filtered electrical connector assembly of claim 2 wherein said first complementary interengaging latch means are constructed to mount the terminal alignment plate on the housing with the through holes in the alignment plate generally perpendicular to the passageways in the housing.

4. The multi-terminal filtered electrical connector assembly of claim 1 wherein said terminal alignment plate includes a cavity into which the ferrite block is mounted.

5. The multi-terminal filtered electrical connector assembly of claim 4 wherein said second complementary interengaging latch means are located at at least one side of the cavity.

6. The multi-terminal filtered electrical connector assembly of claim 5 wherein said second complementary interengaging latch means comprise at least one snap-latch device for retaining the ferrite block on the alignment plate automatically in response to mounting the ferrite block into the cavity.

7. The multi-terminal filtered electrical connector assembly of claim 1 wherein said first complementary interengaging latch means comprise at least one snap-latch device for latching the alignment plate to the housing automatically in response to assembling the alignment plate on the housing.

8. The multi-terminal filtered electrical connector assembly of claim 1 wherein said second complementary interengaging latch means comprise at least one snap-latch device for latching the ferrite block to the alignment plate automatically in response to assembling the ferrite block on the alignment plate.

9. The multi-terminal filtered electrical connector assembly of claim 1, including a flexible capacitor filter circuit mounted on the housing and through which the terminals extend.

10. The multi-terminal filtered electrical connector assembly of claim 9, wherein the housing has a rear face with said passageways communicating therethrough, and said flexible capacitor filter circuit is generally flat, mounted against the rear face and including a plurality of chip capacitors operatively associated with said tail portions of the terminals passing through the filter circuit.

11. The multi-terminal filtered electrical connector assembly of claim 1, including a flexible capacitor filter circuit mounted on the alignment plate and ferrite block subassembly and through which the terminals extend after passing through the holes in the alignment plate.

12. The multi-terminal filtered electrical connector assembly of claim 1, including a flexible capacitor filter circuit mounted on the housing and a flexible capacitor circuit filter circuit mounted on the terminal alignment plate and ferrite block subassembly through which filter circuits all the terminals extend.

* * * * *